US007942243B1

(12) United States Patent
Blehm

(10) Patent No.: US 7,942,243 B1
(45) Date of Patent: May 17, 2011

(54) INTERMEDIATE CABLE FAIRLEAD

(76) Inventor: Berle G. Blehm, Oroville, CA (US)

( * ) Notice: Subject to any disclaimer, the term of this patent is extended or adjusted under 35 U.S.C. 154(b) by 0 days.

(21) Appl. No.: 12/697,565

(22) Filed: Feb. 1, 2010

(51) Int. Cl.
*E04G 1/08* (2006.01)

(52) U.S. Cl. ..... 182/103; 414/800

(58) Field of Classification Search ..... 414/571, 414/538, 490, 800, 10; 182/103
See application file for complete search history.

(56) References Cited

U.S. PATENT DOCUMENTS

| | | | | | |
|---|---|---|---|---|---|
| 156,541 | A | | 11/1874 | Conrad and Fahringer | |
| 2,394,148 | A | | 2/1946 | Campbell | |
| 2,405,505 | A | | 8/1946 | Kleidon | |
| 2,459,621 | A | | 1/1949 | Cobb | |
| 2,628,071 | A | | 6/1949 | Williams | |
| 3,115,211 | A | * | 12/1963 | Ostrander, Jr. | 182/103 |
| 3,666,054 | A | | 5/1972 | Ellings | |
| 3,671,015 | A | | 6/1972 | Sullivan | |
| 4,183,423 | A | * | 1/1980 | Lewis | 182/103 |
| 4,441,849 | A | | 4/1984 | Dizmang | |
| 4,598,795 | A | * | 7/1986 | Larson | 182/129 |
| 4,972,922 | A | * | 11/1990 | Levine | 182/45 |
| 4,986,571 | A | * | 1/1991 | Godbersen | 280/854 |
| 5,079,795 | A | * | 1/1992 | Schmid | 15/257.06 |
| 5,341,898 | A | | 8/1994 | Baziuk | |
| 5,624,006 | A | | 4/1997 | Richardson, Jr. | |
| 5,738,185 | A | | 4/1998 | Sears | |
| 5,911,287 | A | | 6/1999 | Campbell | |
| 6,244,381 | B1 | | 6/2001 | Ruble | |
| 6,276,666 | B1 | | 8/2001 | Roberts | |
| 6,454,049 | B1 | | 9/2002 | Dorsett | |
| 6,926,241 | B2 | | 8/2005 | Garrett | |
| 7,424,932 | B1 | | 9/2008 | Murphy | |
| 7,493,737 | B2 | | 2/2009 | Smith | |
| 7,546,902 | B2 | * | 6/2009 | Schwertner | 187/241 |
| D615,725 | S | * | 5/2010 | Phillips | D34/28 |
| 2007/0059142 | A1 | | 3/2007 | Dambroseo | |

* cited by examiner

*Primary Examiner* — Charles A Fox
(74) *Attorney, Agent, or Firm* — William Bodnar

(57) ABSTRACT

An intermediate cable fairlead is comprised of a frame assembly, a left and right wheel assembly affixed to the frame assembly, and a pulley wheel attached to the wheel assembly. The intermediate cable fairlead can be attached to a ladder and utilized to move material from the ground up to or over the intermediate cable fairlead. The device can also be utilized as a stop to hold a load in position on a ladder.

20 Claims, 6 Drawing Sheets

INTERMEDIATE CABLE FAIRLEAD

CROSS REFERENCE TO RELATED APPLICATIONS

None.

FIELD OF THE INVENTION

This present invention relates to a device for loading materials on a ladder.

BACKGROUND OF THE INVENTION

The present invention relates generally to an apparatus that can be used to lift a load from the ground to the roof eave or to the roof of a building. More particularly the intermediate cable fairlead or material loading device may be used in conjunction with a ladder and winch to hoist materials up to the eave of a roof and/or hoist materials from the eave of a roof to the peak of a roof.

Extreme difficulty is often encountered in lifting heavy objects to the top of a building, onto a roof, or from the eave of a roof to the roof peak. This can be accomplished with a crane, but the expense of using a crane is often prohibitive. For example, it would be too expensive to rent a crane to transport roofing materials from the ground to the roof or from the eave of a roof to the roof peak. In addition, it would be difficult and expensive to transport a large piece of equipment such as a crane to a job site. If obstacles do not permit a lifting machine to be used to lift materials from the ground to the roof eave, the material loading device can be used for such a purpose.

There is a need for an apparatus that can be easily attached to a single section ladder or an extension ladder and used to lift loads to the eave of a roof of a building. There is also a need for such an apparatus to allow lifting loads over the eave of a roof to a higher elevation on the roof. The portability of such an apparatus is important so that it can be transported to and from a jobsite easily and can be affixed to and removed from a ladder by a worker with a minimum of effort.

Moreover, the apparatus should also be capable of being used with a winch so that heavy loads may be lifted to the roof eave or over the roof eave to the top of a ladder positioned on a roof.

SUMMARY OF THE INVENTION

It is an object of this invention to provide a material loading device that may be used with an extension ladder and winch. It is still another object of this invention to provide a material loading device that may be easily attached to and removed from the extension ladder.

It is another object of this invention to provide a material loading device that may be easily transported to a job site. It is still another object of this invention to provide a material loading device that may be used to lift heavy and/or cumbersome loads to the top of a building or onto a roof.

Embodiments of the present invention can also be utilized to move a material load from the eave of the roof to the peak of the roof without damaging the roof structure. At least one of the stated objects will be satisfied by embodiments of the present invention.

BRIEF DESCRIPTION OF DRAWINGS

The character of the invention, however, may be best shown by reference to an embodiment of its structural form, as illustrated by the accompanying drawings.

Referring to FIG. 1, which shows the general features of a preferred embodiment of the invention, the material loading device 10 has two outside support arms or rails 12 attached to an angle support/stop component 14. Two inside adjustable arms 16 are attached to the angle support/stop component. A wheel pulley 18 is situated between the inside adjustable arms.

Figure 1:
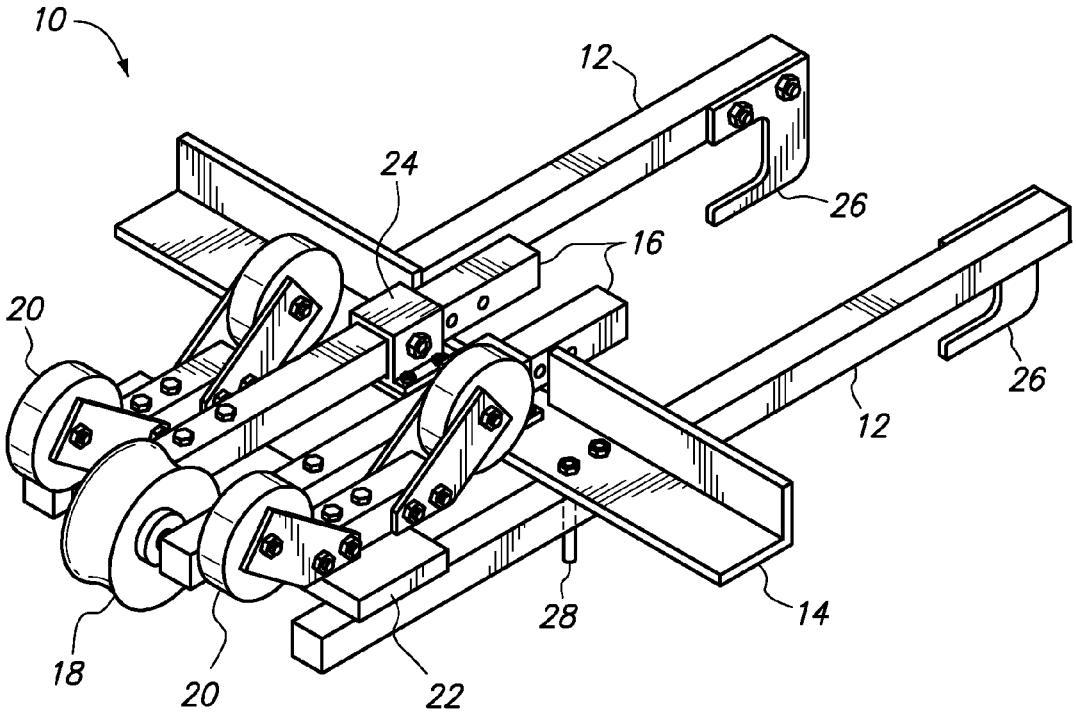
FIG. 1 shows the material loading device 10.

Wheels 20 are connected to a support base/plate 22 which is directly connected to the adjustable inside arms or rails. The adjustable arms 16 are connected to the angle support/stop through a housing 24. The arms 16 are adjusted by removing securing pins or bolts from housing 24 and realigning other positioning holes with the openings in the housing. The adjustable arms 16 are in a fixed relationship with each other through support base 22 which slides along the outside arms 12. The wheels 20 and pulley 18 can thus be adjusted to extend beyond the roof eave to facilitate clearance of a load past the eave and/or gutter.

The material loading device can be positioned on a ladder, for example, that is lying on a roof. The material loading device is attached to the ladder by first hooking the ladder rung engagement components 26 over the rungs of the ladder. The other end of the device is then lowered into place on top of the ladder so that the vertical safety stop 28 is near another ladder rung to prevent the upward movement of the material loading device with respect to the ladder.

Figure 2:
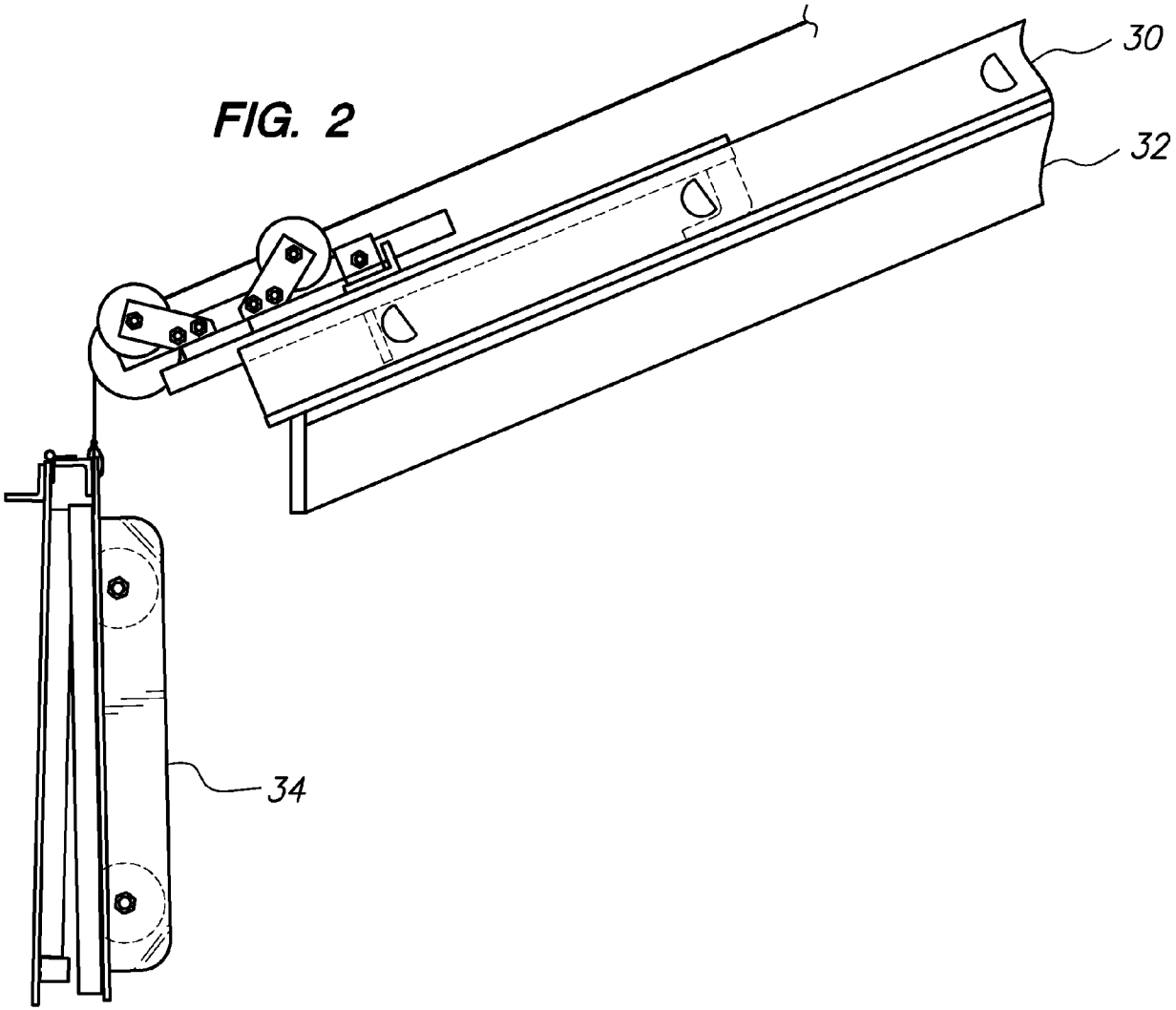
FIG. 2 shows the material loading device attached to ladder on the roof of a building. A load is being lifted.
Figure 3:
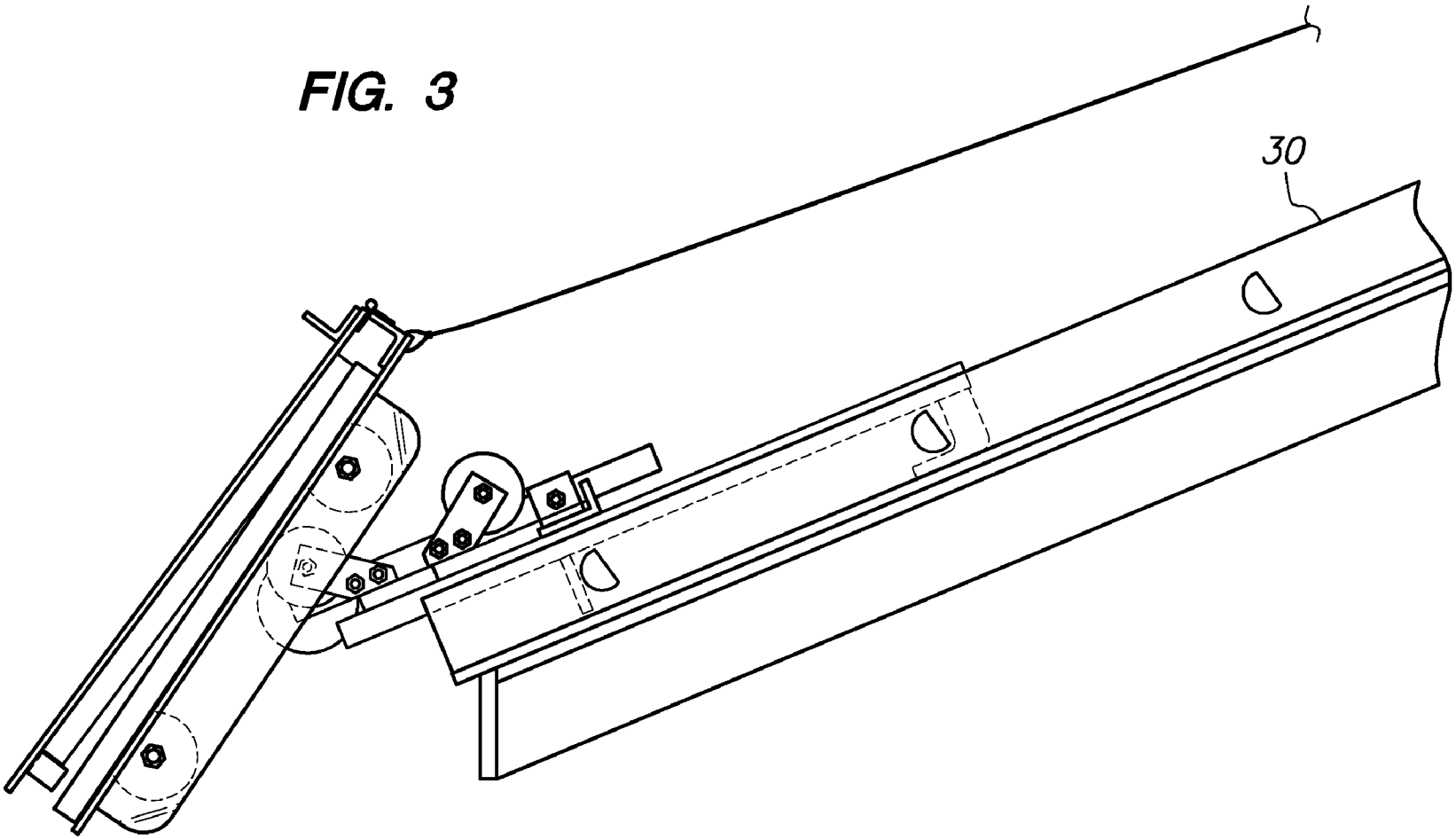
FIGS. 3, 4 and 5 show the various stages as a load is lifted up to, onto, and over the material loading device.
Figure 4:
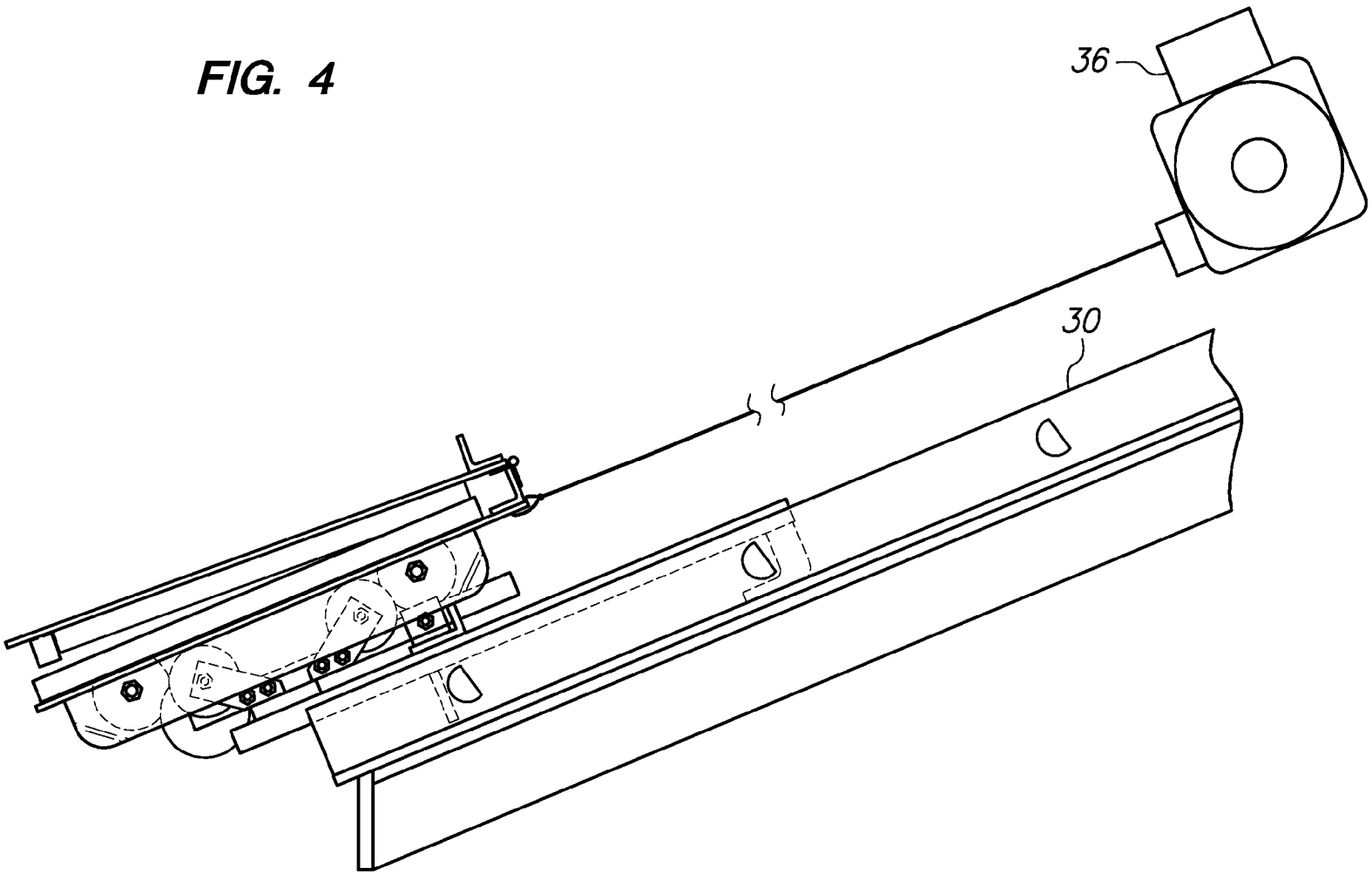

FIG. 2 shows the material loading device in position attached to a ladder 30 on the roof 32 of a building. The load being lifted here is a material transport apparatus 34. FIG. 3 illustrates the load as it is lifted and contacts the lower wheels of the material loading device. The load continues to be pulled over the eave of the roof (via a winch 36 for example) until the bottom of the load rests on all of the wheels as shown in FIG. 4.

Figure 5:
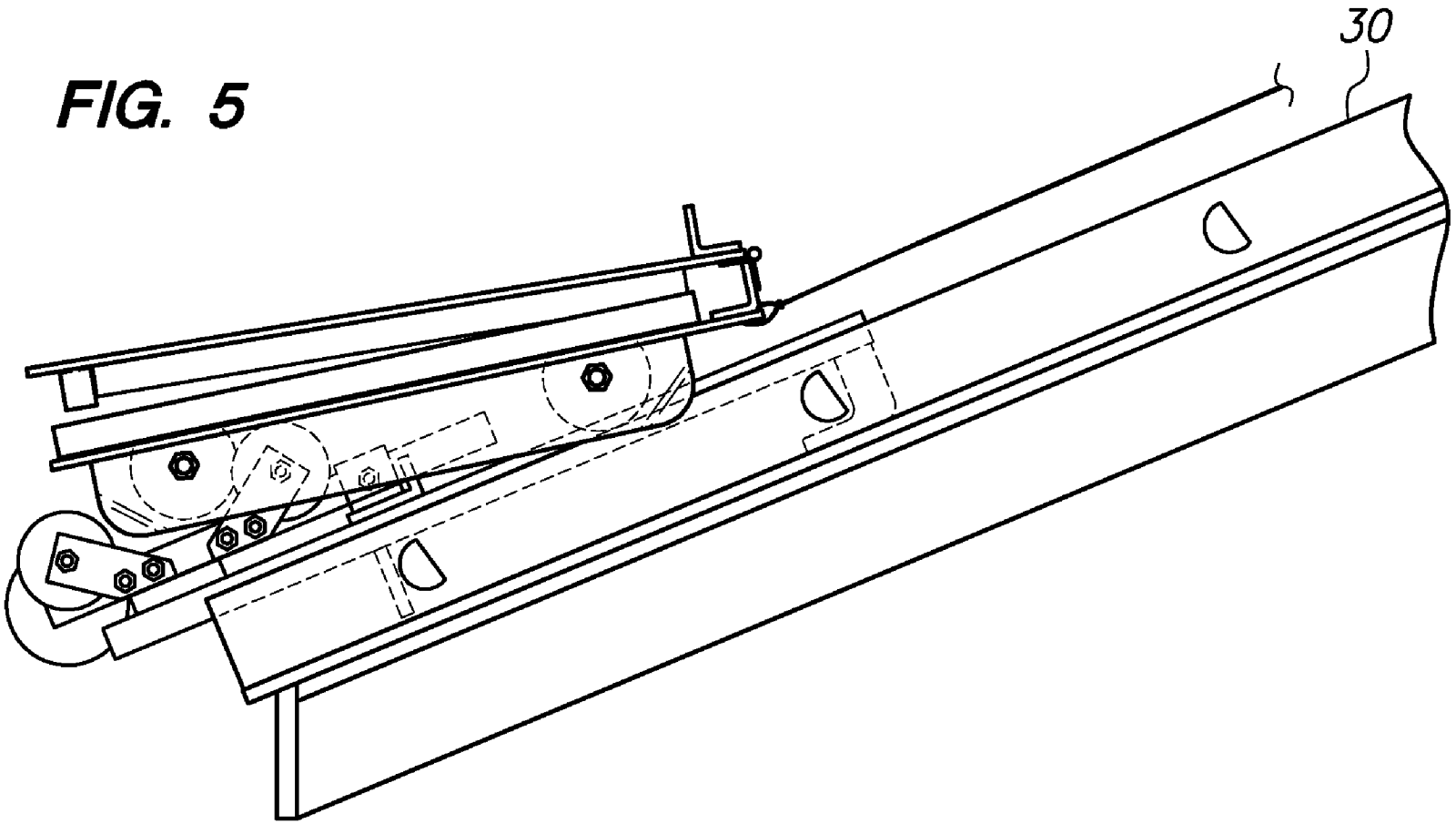
Figure 6:
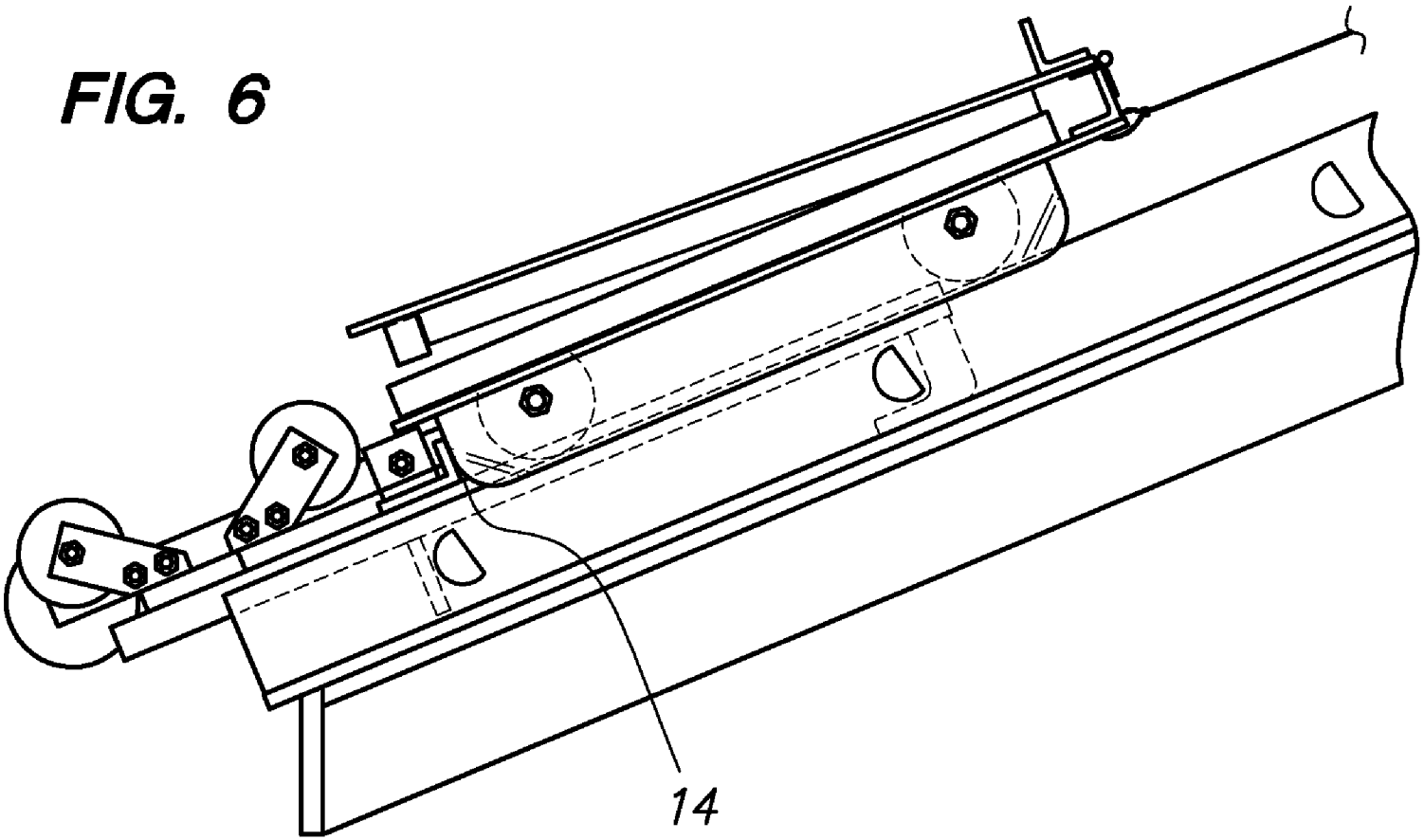
In FIG. 6, the load has been lifted past the device onto a ladder on the roof. The load is resting against the device which is utilized as a stop for the load.

As the load is pulled further up and the front of the load contacts the ladder, only the upper wheels of the material loading device are in contact with the bottom of the load as shown in FIG. 5. When the load is pulled completely past the material loading device onto the ladder, the load can be lowered slightly so that it rests against the angle stop 14 as illustrated in FIG. 6.

CONCLUSIONS, OTHER EMBODIMENTS, AND SCOPE OF INVENTION

The material loading device disclosed herein presents a novel apparatus that can be utilized to lift materials to the eave of a roof and/or from the eave of a roof to the peak of the roof. The device can be used to lower material loads as well. The device can also be used as a stop to support a load that is being transported up a ladder. FIGS. 2 through 6 clearly illustrate how a load can be lifted from the ground up over the roof eave and onto the roof. A winch (not shown in the illustrations) is typically used to lift the load. As illustrated in FIG. 6, the device can also act as stop to hold a load in place on a ladder and prevent downward movement.

The material loading device can be utilized with a single section or extension ladder on a roof top. If a load is being moved along the rails of a ladder resting against a building, the over eave device can be utilized as a stop when placed on the ladder rungs below the load to be supported/stopped.

Other embodiments of the invention may be apparent to those skilled in the art from a consideration of the specification or practice of the invention disclosed herein. It should be evident that this disclosure is by way of example and that various changes may be made by adding, modifying, or eliminating details without departing from the fair scope of the teachings contained in this disclosure. The invention is therefore not limited to particular details of this disclosure except to the extent that the following claims are necessarily so limited. Thus it is intended that the specification and examples be considered as illustrative only, with the true scope and spirit of the invention being indicated by the following claims.

What is claimed is:

1. An intermediate cable fairlead for use with a ladder having ladder rails comprising:

a frame assembly including a pair of outside and a pair of inside rails secured in position by two or more cross members;

a left and right wheel assembly affixed to the frame assembly, each wheel assembly including a pair of wheels held inline relative to one another along the direction of rotation of the wheels, the wheels elevated above the frame assembly; and a pulley wheel axially mounted between the inside rails, the pulley wheel for seating a cable attached to a material load or load platform and to a pulling source;

wherein the intermediate cable fairlead is attachable to a ladder elevated above ground and the material load or load platform is pulled by the pulling force up to or over the intermediate cable fairlead by pulling the cable aided by the pulley wheel in the direction opposite the material load or load platform.

2. The intermediate cable fairlead of claim 1 wherein the pair of outside rails are aligned and spaced apart in a substantially parallel relationship, each rail having a hooked end disposed in the same direction.

3. The intermediate cable fairlead of claim 2 wherein the pair of inside rails are aligned and spaced apart in a substantially parallel relationship, the inside and outside rails aligned in a same direction.

4. The intermediate cable fairlead of claim 2 attachable to a ladder by placing the hooked ends of the outside rails over a ladder rung the outside rails resting against the ladder rungs.

5. The intermediate cable fairlead of claim 2 further including a left and right rung stop extending below the outside rails, the rung stops marking a distance from the inside edges of the rung stops to the inside edges of the hooked ends, the distance just greater than the distance defining the outside edge to outside edge of consecutive rungs on a ladder.

6. The intermediate cable fairlead of claim 1 wherein one of the two or more cross members is a base plate horizontally disposed between the pairs of outside and inside rails, the inside rails affixed to the base plate such that the inside rails are held elevated above the outside rails.

7. The intermediate cable fairlead of claim 6 wherein one of the two or more cross members is an angle plate horizontally disposed between the pairs of outside and inside rails, the rails affixed to the angle plate such that the elevation of the pair of inside rails over the pair of outside rails is maintained.

8. The intermediate cable fairlead of claim 7 wherein the angle plate has a cutout through a material stop wall of the plate to provide relief for the inside rails to pass through.

9. The intermediate cable fairlead of claim 7 wherein the angle plate serves as a load stop after the material load or load platform is pulled over and beyond the frame assembly and onto the ladder.

10. The intermediate cable fairlead of claim 7 wherein the inside rails are fixed to the angle plate by a pair of rectangular housings attached to the angle plate.

11. The intermediate cable fairlead of claim 10 wherein the inside rails and pulley wheel axially mounted there between, and base plate may be loosened as an assembly from the rectangular housings enabling repositioning of the assembly relative to the angle plate.

12. The intermediate cable fairlead of claim 6 wherein the left and right wheel assemblies are mounted to the base plate, the wheels linearly disposed in the same direction as the inside and outside rails.

13. A method for pulling a material load or load platform up to and onto a ladder elevated above the ground comprising the steps:

(a) securing an intermediate cable fairlead having a frame assembly including a pair of outside and a pair of inside rails secured in position by two or more cross members, a left and right wheel assembly, each wheel assembly including a pair of wheels held inline relative to one another along the direction of rotation of the wheels, and a pulley wheel axially mounted between the inside rails to the ladder;

(b) extending a cable from a pulling source seating the cable over the pulley of the material load device;

(c) securing the cable to the material load or load platform; and (d) retracting the cable until the material load or load platform has been pulled over the wheels of the intermediate cable fairlead and onto the ladder.

14. The method of claim 13 wherein in step (a) each rail of the pair of outside rails has a hooked end disposed in the same direction.

15. The method of claim 14 wherein in step (a) the intermediate cable fairlead is secured to the ladder by placing the hooked ends of the outside rails over a rung on the ladder the outside rails resting against the rungs of the ladder.

16. The method of claim 13 wherein in step (a) one of the two or more cross members is an angle plate and one of the two or more cross members is a base plate.

17. The method of claim 13 wherein in step (b) the pulling source is a manual or an electric winch.

18. The method of claim 13 wherein in step (a) one of the two or more cross members is an angle plate horizontally disposed between the pairs of outside and inside rails.

19. The method of claim 18 wherein in step (a) the inside rails are fixed to the angle plate by a pair of rectangular housings attached to the angle plate.

20. The method of claim 19 wherein in step (a) the angle plate has a cutout through the material stop wall of the plate to provide relief for the inside rails to pass through.

* * * * *